United States Patent [19]

Trakhtenberg et al.

[11] 4,024,744

[45] May 24, 1977

[54] DEVICE FOR EXPLOSIVE GAS FORMING

[76] Inventors: Jury Borisovich Trakhtenberg, Brest-Litovsky prospekt, 162-a, kv. 29; Vasily Grigorievich Oleshko, ulitsa Kreschatik, 21, kv. 106; Vladimir Ivanovich Klimentiev, Novo-Gostomelskoe shosse, 16 "d", kv. 53; Alexandr Iosifovich Zapunny, ulitsa Miljutenko, 10, kv. 23; Yaroslav Nikolaevich Robakovsky, ulitsa Belorusskaya, 1, kv. 29; Vladimir Petrovich Rossikhin, ulitsa Akademika Tupoleva, 16 "d", kv. 53; Boris Yakovelevich Maximuk, ulitsa Fabrichnaya, 2, kv. 60, all of Kiev, U.S.S.R.

[22] Filed: July 19, 1976

[21] Appl. No.: 706,907

Related U.S. Application Data

[63] Continuation of Ser. No. 632,777, Dec. 17, 1975, abandoned, which is a continuation of Ser. No. 542,700, Jan. 21, 1975, abandoned.

[52] U.S. Cl. ..... 72/56

[51] Int. Cl.² ..... B21D 26/08

[58] Field of Search ..... 72/63, 60, 56, 54; 431/172; 102/DIG. 2

[56] References Cited

UNITED STATES PATENTS

| | | | |
|---|---|---|---|
| 2,210,551 | 8/1940 | Lengyel | 431/172 |
| 3,236,080 | 2/1966 | Illgen | 72/56 |
| 3,269,446 | 8/1966 | Luther | 431/172 |
| 3,342,048 | 9/1967 | Johnson et al. | 72/56 |
| 3,654,788 | 4/1972 | Kimura | 72/56 |
| 3,742,746 | 7/1973 | Erlandson | 72/56 |

*Primary Examiner*—Milton S. Mehr

[57] ABSTRACT

A device wherein an explosion chamber accommodates a part shaped as a body of revolution forming with the internal side surface of the explosion chamber an annular space filled with a gas mixture, the magnitude of said space in the chamber cross-section being varied in the direction of propagation of the detonation wave front so as to transfer detonation conditions of the gas mixture burning in the explosion chamber; the arrangement of the part within the explosion chamber offers a reduction in the consumption of the gas mixture, as compared with the known devices for explosion gas-forming, and in metal requirements for the manufacture of the explosion chamber.

7 Claims, 7 Drawing Figures

DEVICE FOR EXPLOSIVE GAS FORMING

This is a continuation of application Ser. No. 632,777, filed Dec. 17, 1975, now abandoned, which in turn is a continuation of application Ser. No. 542,700, filed Jan. 21, 1975, now abandoned.

FIELD OF THE INVENTION

The present invention relates to metal working by pressure and more particularly to devices for explosive gas forming.

BACKGROUND OF THE INVENTION

The invention may prove to be most advantageous in aircraft industry and in shipbuilding for producing intricate components from sheet blanks.

The device for explosive gas-forming according to the present invention can also find favour in chemical, petroleum and boiler engineering.

Known in the art are devices for explosive gas-forming, comprising a die mounted on one plate and an explosion chamber with an adjacent detonation tube mounted on another plate rigidly fixed to the first one. The detonation tube accommodates a gas mixture igniter. The die, explosion chamber and detonation tube are aligned axially and mounted in succession one above another. The internal surface of the explosion chamber is shaped as a truncated cone with a cone large base facing the die and a small base - the detonation tube.

The explosion chamber communicates with a gas mixture source and accommodates means for exhausting gas mixture combustion products (c.f. see USSR author's certificate No. 14870).

It is known that in order to provide a stable propagation of a detonation wave in a gas mixture of a particular composition, the explosion chamber must have a certain angle of taper. If this angle exceeds a certain critical angle, the detonation wave generated in such chamber will be disturbed. Thus, for a stoichiometric mixture of methane and oxygen, the critical angle is equal to 25°. Therefore the shaping of large-size components requires explosion chambers of a comparatively large lengths, this in turn causing a higher gas mixture consumption in the course of operation.

Moveover, such devices are metal-consuming and, hence, expensive in production.

OBJECTS AND SUMMARY OF THE INVENTION

The main object of the present invention is the provision of a device for explosive gas forming, wherein the inherent design of an explosion chamber would enable a reduction in its overall dimensions and, hence, in metal consumption for its fabrication by preserving identical parameters of the forming process as compared with the known devices.

Another object of the invention is to provide a lower consumption of a gas mixture in the course of operation of the proposed device.

Said and other objects are achieved in a device for explosive gas-forming in which a die for arranging a blank is mounted on one plate and an explosion chamber communicating with a gas mixture source is disposed on another plate arranged parallel to the first plate and connected thereto, said chamber being adjacent with one its side to the die, with a detonation tube carrying a gas mixture igniter being coupled to the opposite side of said chamber, wherein according to the invention, the explosion chamber accommodates a part shaped as a body of revolution whose external surface and the internal side surface of the explosion chamber form an annular space filled with a gas mixture, with the magnitude of this space being varied in the explosion chamber cross-section in the directon of propagation of the detonation wave front so as to transfer detonation conditions of the gas mixture burning in the explosion chamber.

It is expedient that the part be mounted in the explosion chamber with a possibility of its adjustable axial displacement.

This would make it possible to adjust the magnitude of the space between the end face surface of the part and the internal end face surface of the chamber which, in turn, would provide optimum detonation combustion conditions when operating on gas mixtures of different types.

It is no less expedient that the part be a conical body with its base facing the end face of the detonation tube, and the internal side surface of the explosion chamber be shaped as a truncated cone with its large base facing the die.

Such outlines and the above described mutual arrangement of the part and explosion chamber ensure minimum overall dimensions of the proposed device.

It is sound practice that the part be provided with a cavity adapted to be partially filled with liquid through which the part would be cooled during forming.

The use of a hollow part diminishes its metal requirements and increases both functional stability and production rate of the device owing to the forced cooling of the part.

It is another embodiment where the part is made hollow and barrel-shaped with its side wall produced from a resilient material and is adapted for filling it with liquid under pressure selected in accordance with the composition and initial pressure of the gas mixture.

With the above arrangement both the shape and size of the part can be altered at a change in the composition and concentration of a gas mixture fed into the explosion chamber and, hence, a preset blank forming force can be maintained.

The part may also have a side surface equidistant from the internal surface of the explosion chamber, and through ducts running in the part body in the direction of propagation of the detonation wave front and selectively closed to provide local straining of the blank.

Positive results may be also achieved with a drop-shaped part forming with the internal side surface of the explosion chamber an annular space shaped as a converging-diverging nozzle.

The speed of detonation combustion products of a gas mixture passing through the above space increases in the diverging part of the nozzle with the ensuing rise in the pressure acting on the blank being processed.

As compared with the known devices, the device for explosive gas-forming according to this invention requires lower investments for its fabrication.

Moreover, gas mixture consumption in the course of operation of the device is 1.5–4 times less as compared with the known devices, the parameters (pressure magnitude and its distribution pattern on the blank surface) being identical.

Other objects and advantages of this invention will become more apparent from the following detailed description of exemplary embodiments thereof, to be had with reference to the accompanying drawings, wherein:

DETAILED DESCRIPTION OF THE PREFERRED EMBODIMENTS

Figure 1:
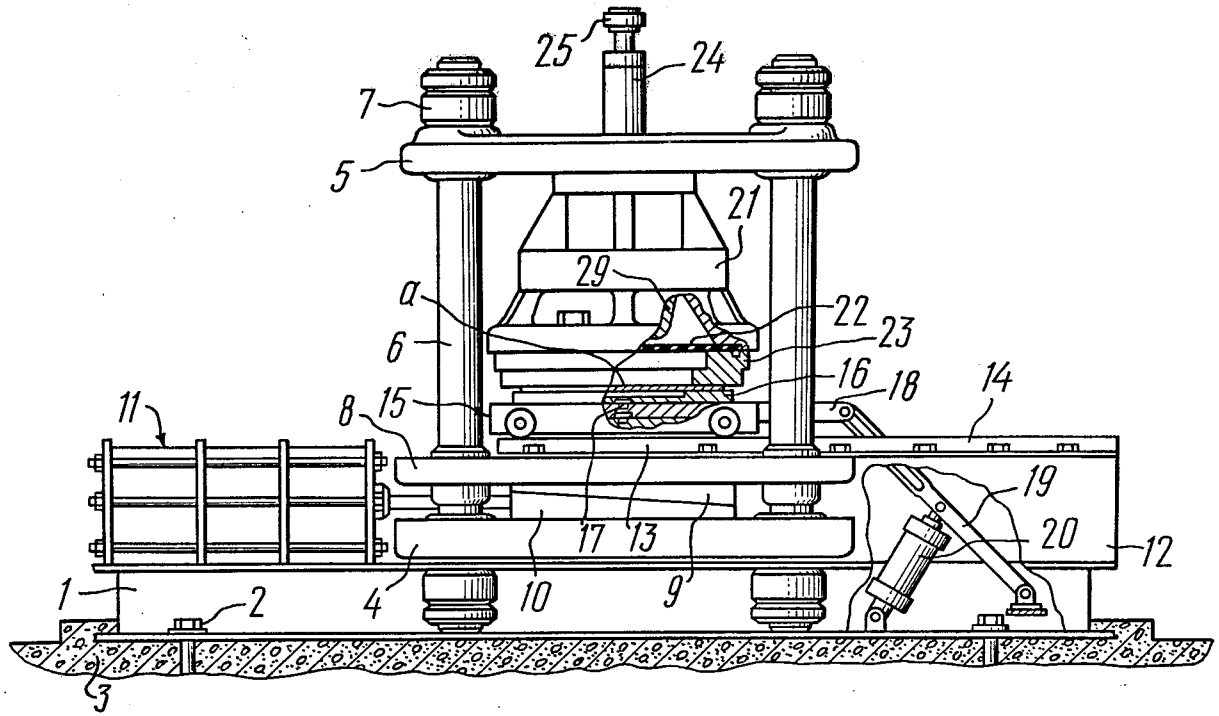
FIG. 1 is a general view with a fragmentary cutaway of the device for explosive gas-forming, according to the invention.

A device for explosive gas forming comprises a base plate 1 (FIG. 1) fixed with bolts 2 on a concrete pad 3.

The base plate 1 carries a bottom plate 4 rigidly connected to a top plate 5 by means of columns 6 and nuts 7.

Mounted for movement in a vertical direction on the columns 6 between the bottom plate 4 and top plate 5 is an intermediate plate 8.

Vertical displacement of the plate 8 is effected by means of a wedge assembly comprising two wedges: a wedge 9 secured to the plate 3 on its bottom side and a movable wedge 10 mounted movably on the plate 4. The wedge 10 is connected to the rod of an air cylinder 11 installed on the base plate 1.

Tracks 13 and 14, along which travels a carriage 15 with a die 16 mounted thereon, are secured accordingly on the upward protruding section 12 of the base plate 1 and on the intermediate plate 8. The die 16 is fixed on the carriage 15 with locators 17. The carriage 15 has a bracket 18 secured thereon and coupled through a link 19 with an air cylinder 20 for moving the carriage 15 along the tracks 13 and 14.

Secured to the top plate 5 is an explosion chamber 21 adjacent with one its side through a rubber diaphragm 22 and a clamp 23 to a blank *a* placed on the die 16.

The opposite side of the explosion chamber 21 adjoins a detonation tube 24 with a gas mixture igniter 25 which may be a spark plug. The inside diameter of the detonation tube 24 is less than the minimum diameter of the explosion chamber 21.

The explosion chamber 21 is connected through a gas supply system 26 (FIG. 2) to sources 27 and 28 of gas mixture components methane and oxygen accordingly.

Figure 3:
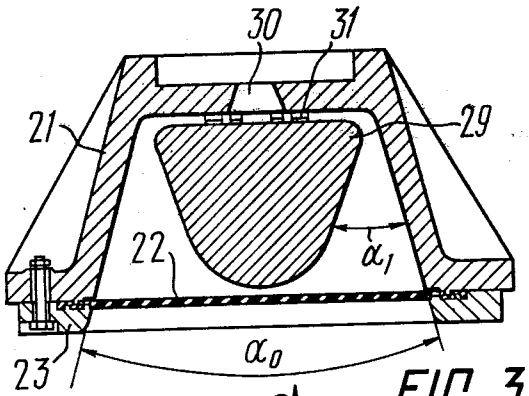
FIG. 3 is an enlarged longitudinal sectional view of the explosion chamber at a first embodiment — with a conical part.

The explosion chamber 21 accommodates a part 29 (FIG. 3) shaped as a body of revolution whose external surface and the internal side surface of the explosion chamber form an annular space filled with a gas mixture. The magnitude of this space in the cross-section of explosion chamber 21 is varied in the direction of propagation of the detonation wave front so as to preserve detonation conditions of the gas mixture burning in the explosion chamber 21.

The part 29 is a conical body with its base facing the end face of the detonation tube 24 (FIG. 1), and the internal side surface of the explosion chamber 21 is a truncated cone with its large base facing the die 16. With such a mutual arrangement of the part 29 and chamber 21 minimum overall dimensions of the proposed device are ensured.

To transfer the detonation combustion regime, the explosion chamber must have a certain angle of taper for each particular gas mixture composition. If the above angle exceeds a certain critical value "$\alpha_k$", the detonation wave ejected from the detonation tube of a small cross-section into the explosion chamber will be disturbed.

In case the part 29 is accommodated in the explosion chamber 21 having an angle $\alpha_c$ exceeding $\alpha_k$, an angle $\alpha_1$ formed between the external surface of the part 29 and internal surface of the explosion chamber 21 will be less than the critical angle $\alpha$, i.e.$\alpha_1,\alpha_k$and this, in turn, will allow reducing the length of the explosion chamber 21 and, hence, its metal requirements and gas mixture consumption in the course of operation of the proposed device.

The part 29 is fastened to the explosion chamber 21 with studs 30. Each stud, located between the internal end face surface of the chamber 21 and part 29, is fitted with an adjusting washer 31 providing for an adjustable axial displacement of the part 29 relative to the chamber 21 to change the magnitude of the space between the two at a change in gas mixture composition.

Figure 4:
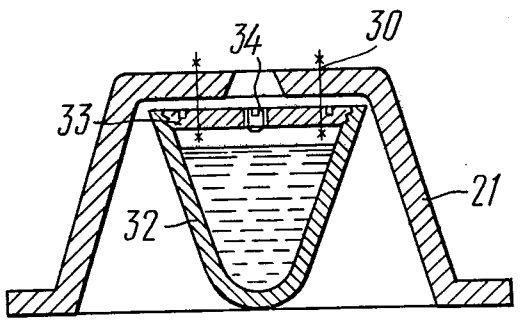
FIG. 4 is a view similar to FIG. 3 of a second embodiment with the cone-shaped part having a cavity filled with liquid.

To decrease metal consumption, a part 32 (FIG. 4) is made hollow and is closed with a cover 33 having an opening for filling it with liquid, said opening being closed with a plug 34.

Owing to the use of the liquid filling the cavity in the part 32 and to its evaporation in the course of detonation, the part 32 and, hence, the chamber 21 are less heated which enhances device stability and yield due to a constant amount (by weight) of the gas mixture introduced into the chamber 21.

Figure 5:
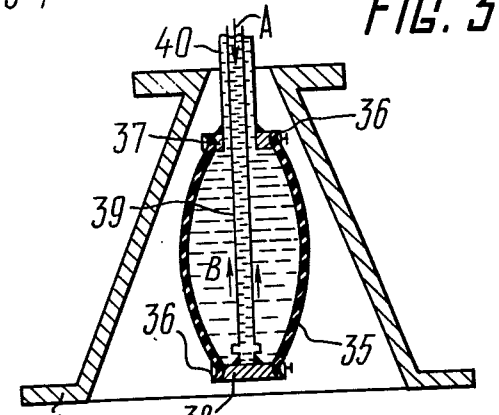
FIG. 5 is a similar sectional view of a third embodiment with barrel-shaped part.

In another embodiment, a hollow barrel-shaped part 35 (FIG. 5) is produced from a resilient material, such as, rubber.

For filling it with liquid, the part 35 referred to hereinafter as a shell is fixed from top and below with yokes 36 fitted accordingly on flanges 37 and 38. The flange 38 is solid and its central portion is welded to a pipe 39 through which the liquid under pressure is fed into the cavity of the shell 35 (in the direction of an arrow A). The flange 37 is welded to an external pipe 40 within which the coaxial pipe 39 is running. The pipe 40 is adapted to discharge the liquid from the cavity of the shell 35, as it is shown with arrows B.

The use of an elastic shell makes it possible to alter the shape of the part 35 at a change in the composition or concentration of gas mixture components ensuring optimum conditions for shaping the blank *a* (FIG. 1).

Figure 6:
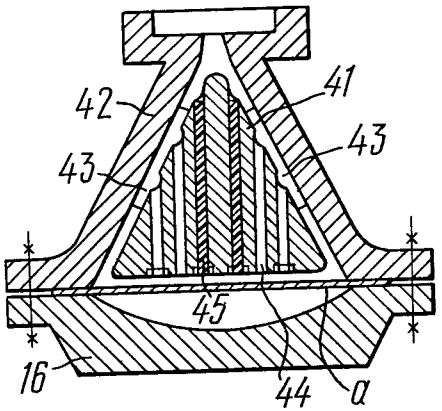
FIG. 6 is a sectional view similar to FIGS. 3–5 showing a fourth embodiment with part fitted with axial ducts.

To provide a still further reduction in the gas mixture consumption and a possibility of local straining of the blank *a* in accordance with the prescribed outline, the side surface of a part 41 (FIG. 6) is equidistant from the internal side surface of the explosion chamber 42 which in the hereindescribed embodiment is cone-shaped with its base facing the blank *a* being formed. The part 41 is secured in the chamber 42 by means of ribs 43. The body of the part 41 is fitted with ducts 44 running in the direction of propagation of the detonation wave and closed selectively with plugs 45 in accordance with the outline of a part being produced (not shown).

Figure 7:
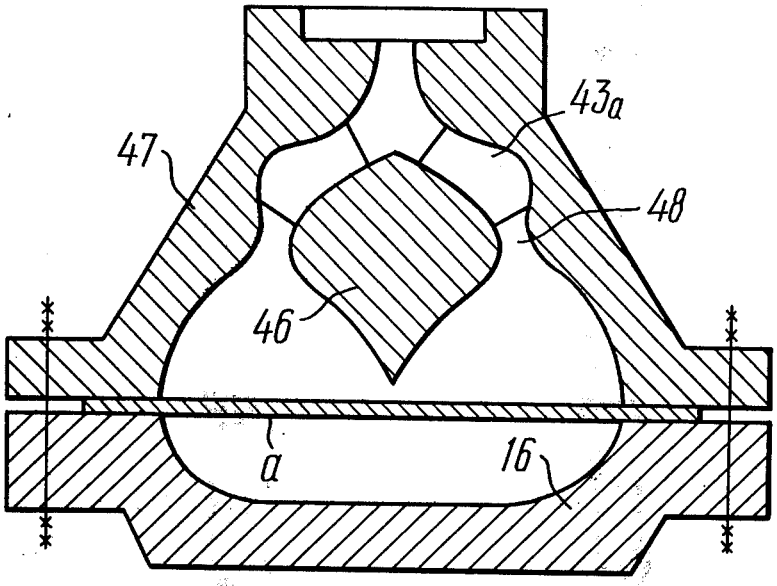
FIG. 7 shows a fifth secitonal embodiment with a drop-shaped part.

To increase the specific pressure acting on the blank *a* (FIG. 7) in the course of shaping in the embodiment under consideration, a drop-shaped part 46 is employed, said part forming with the internal side surface of the explosion chamber 47 an annular space in the shape of a converging-diverging nozzle 48.

The part 46 is made fast with respect to the walls of the chamber 47 with the help of ribs 43*a*.

The outflow of detonation combustion products through the nozzle 48 causes an increase in the speed of a gas stream in the diverging portion of the nozzle 48 and, hence, in the pressure acting on the blank *a:*

The device for explosive gas forming disclosed hereinbefore operates in the following manner.

In the initial position, the intermediate plate 8 is in its extreme lower position, the tracks 13 and 14 are abutted, and the movable wedge 10 is shifted to its extreme left-hand (according to the drawing) position. The carriage 15 with the die 16 is put on the tracks 14 running on the section 12 of the base plate 1. The operator places the blank *a* on the die 16 and actuates the air cylinder 12 which moves the carriage 15 through the link 19 along the tracks 14 and 15 under the explosion chamber 21.

The air cylinder 11 displaced the movable wedge 10 to an extreme right-hand (according to the drawing) position under the wedge 9. As a result, the intermediate plate 8 is lifted, the die 16 with the blank *a* placed thereon being tightly urged to the explosion chamber 21.

Figure 2:
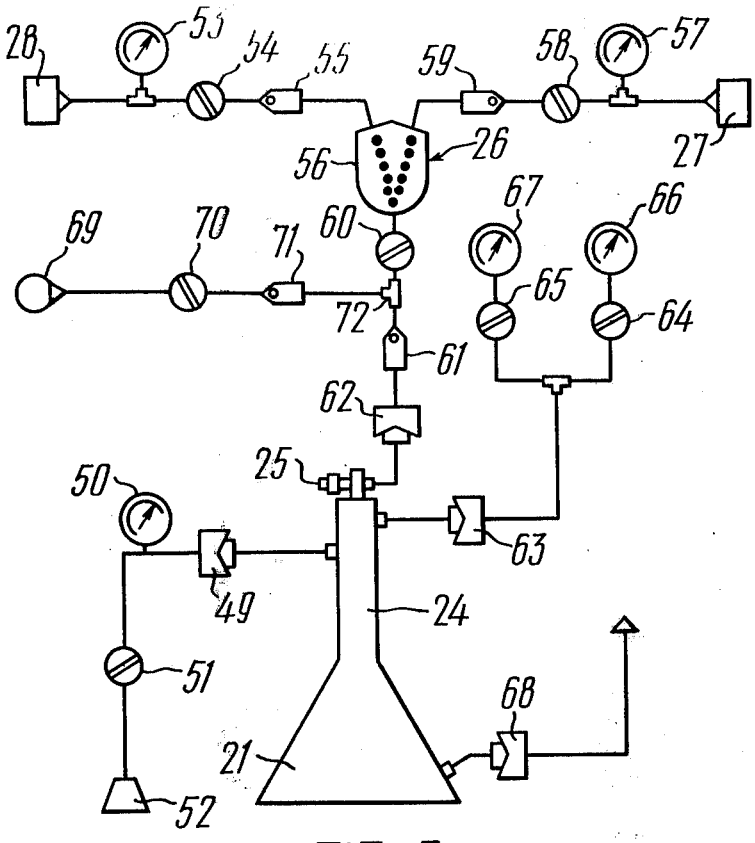
FIG. 2 is a schematic diagram of the system for explosive gas-forming.

Next, to preserve a uniform composition of the gas mixture fed into the explosion chamber, the latter is evacuated by connecting it to a vacuum pump 52 through a cut-off means 49, pressure gauge 50 and a cock 51 (FIG. 2).

Upon evacuating the cavities of the chamber 21, the vacuum pump 52 is stopped and the gas supply system 26 is activated. To this end, oxygen from the oxygen source 28 is supplied through a pressure gauge 53, an electric control valve 54 and a nonreturn valve 55 into a gas mixer 56 wherein methane is introduced simultaneously through a pressure gauge 57, cock 58 and nonreturn valve 59.

A homogeneous gas mixture produced in the mixer 56 is supplied into the detonation tube 24 and explosion chamber 21 through a cock 60, nonreturn valve 61 and a cut-off means 62. When the filling of the explosion chamber 21 with the gas mixture supplied is initiated, pressure gauges 66 and 67 through a cut-off means 63 and cocks 64 and 65 register a rise in pressure inside the chamber.

As soon as the requisite pressure is attained, the gas supply system 26 (comprising the mixer 56, cock 60, nonreturn valve 31 and the cut-off means 62) and the pressure gauges 66 and 67 are valved-off. The device is prepared for forming the blank *a*.

The operator triggers the igniter 25 which lights the gas mixture filling the detonation tube 24 and explosion chamber 21. As a result, a flame front is formed in the detonaton tube 24, said flame front travelling along the tube.

The flame front propagates at a progressively growing speed along the tube 24, this entrailing the formation of a detonation wave which is ejected into the explosion chamber 21 accommodating the part 29. The shape of the part 29 is selected so as to decrease the volume of gas admitted into the chamber 21. The detonation wave propagates uniformly without being disturbed in the annular space formed by the external surface of the part 29 and the internal walls of the chamber 21. Under the effect of the detonation wave acting on the blank *a* through the rubber diaphragm 22 and a thin layer of water provided above it, the blank *a* is shaped into the form of the die 16.

To remove detonation products obtained after explosive-forming the chamber 21 is connected through the cut-off means 68 to the atmosphere. At the same time, to ensure more thorough cleaning and partial cooling of the chamber 21, it is blown with air delivered from a compressed air source 69 which is connected to the chamber 21 through a cock 70, nonreturn valve 71, T-pipe 72 and the nonreturn valve 61 and cut-off means 62.

Upon cleaning the explosion chamber 21 from the detonation products the supply of compressed air is stopped and after the pressure in the chamber 21 has dropped to the atmospheric pressure value, the cut-off means 68 is connecting the explosion chamber to the atmosphere is shut-off.

Next, the air cylinder 11 shifts the wedge 10 to an extreme left-hand position, the intermediate plate 8 being thereby powered, whereupon the air cylinder 12 rolls the carriage 15 with the die 16 off to the initial position. The finished part is removed, a new blank is placed and the forming cycle is repeated.

What we claim is:

1. A device for explosive gas-forming, comprising: a first plate; a second plate located parallel to said first plate and connected thereto; a die for supporting a blank, said die being mounted on said first plate; an explosion chamber having a pair of sides one of which is adjacent to said die, said explosion chamber being fixed on said second plate; a detonation tube connected to the opposite side of said explosion chamber; a gas mixture igniter mounted in said detonation tube; means for connecting said explosion chamber to a gas mixture source; a part shaped as a body of revolution set in said explosion chamber defining an annular space formed between the external surface of said part and internal side surface of said explosion chamber; said annular space being filled with a gas mixture; the cross-sectional area of said annular space in the chamber cross-section being varied in the direction of propagation of the detonation wave front so as to preserve detonation conditions of the gas mixture burning in said explosion chamber.

2. The device for explosive gas-forming of claim 1, wherein the part is mounted in the explosion chamber having means for adjustable axial displacement.

3. The device for explosive gas forming of claim 1, wherein the part is a cone-shaped body facing with its base the end face of the detonation tube and the internal side surface of the explosion chamber has a form of a truncated cone facing with its large base the die.

4. The device for explosive gas-forming of claim 3, wherein the part has a cavity adapted to be partially filled with liquid for cooling the part during forming.

5. A device for explosive gas-forming, comprising: a first plate; a second plate located parallel to said first plate and connected thereto; a die for supporting a blank, said die being mounted on said first plate; an explosion chamber having a pair of sides one of which is adjacent to said die, said explosion chamber being fixed on said second plate; a detonation tube connected to the opposite side of said explosion chamber; a gas mixture igniter mounted in said detonation tube; means for connecting said explosion chamber to a gas mixture source; a part shaped as a body of revolution set in said explosion chamber defining an annular space formed between the external surface of said part and internal side surface of said explosion chamber; said annular space being filled with a gas mixture; the cross-sectional area of said annular space in the chamber cross-section being varied in the direction of propagation of the detonation wave front so as to preserve detonation conditions of the gas mixture burning in said explosion chamber, the part is hollow and barrel-shaped with a side wall produced from a resilient material, said part being adaptable for partial filling with liquid under pressure whose value is selected according to the composition and initial pressure of the gas mixture.

6. A device for explosive gas-forming, comprising: a first plate; a second plate located parallel to said first plate and connected thereto; a die for supporting a blank, said die being mounted on said first plate; an explosion chamber having a pair of sides one of which is adjacent to said die, said explosion chamber being fixed on said second plate; a detonation tube connected to the opposite side of said explosion chamber; a gas mixture igniter mounted in said detonation tube; means for connecting said explosion chamber to a gas mixture source; a part shaped as a body of revolution set in said explosion chamber defining an annular space formed between the external surface of said part and internal side surface of said explosion chamber; said annular space being filled with a gas mixture; the cross-sectional area of said annular space in the chamber cross-section being varied in the direction of propagation of the detonation wave front so as to preserve detonation conditions of the gas mixture burning in said explosion chamber, the part having a side surface equidistant from the internal surface of the explosion chamber, and through-ducts running in the body of the part in the direction of propagation of the detonation wave front, said ducts being selectively closed to ensure local straining of the blank.

7. The device for explosive gas forming of claim 1 wherein the part is drop-shaped and forms with the internal side surface of the explosion chamber an annular space shaped as a converging-diverging nozzle.

* * * * *